United States Patent [19]

Pomeroy et al.

[11] 4,004,683

[45] Jan. 25, 1977

[54] PACKAGING FOR POWER LOADS

[75] Inventors: Raymond V. Pomeroy, Portland; Lewis A. Scott, Lake Oswego, both of Oreg.

[73] Assignee: Omark Industries, Inc., Portland, Oreg.

[22] Filed: May 7, 1975

[21] Appl. No.: 575,446

[52] U.S. Cl. ..... 206/3; 102/69; 198/645; 206/347; 206/409; 221/70; 224/13

[51] Int. Cl.[2] ..... B65G 15/00; B65H 5/28; F42B 39/08

[58] Field of Search ..... 102/43 R, 69; 198/131, 198/153, 178, 184; 206/3, 329, 338, 343–347, 409, 443, 526, 820; 224/5 MC, 13–23; 221/70

[56] References Cited

UNITED STATES PATENTS

| | | | |
|---|---|---|---|
| 226,817 | 4/1880 | Woodward et al. | 206/344 |
| 1,289,136 | 12/1918 | Elliott | 206/347 X |
| 2,230,829 | 2/1941 | Cesareo | 221/70 |
| 2,997,163 | 8/1961 | Tel-Wardi | 206/254 |
| 3,163,286 | 12/1964 | Covington, Jr. | 224/5 MC X |
| 3,464,542 | 9/1969 | Downing et al. | 206/347 X |
| 3,478,409 | 11/1969 | Votaw et al. | 206/820 X |
| 3,587,524 | 6/1971 | Keating | 198/131 X |
| 3,861,560 | 1/1975 | Entwistle et al. | 221/70 |

*Primary Examiner*—Steven E. Lipman
*Attorney, Agent, or Firm*—Robert L. Harrington

[57] ABSTRACT

A flexible rubber strip has openings slightly smaller than the shank of a power load spaced along its length. Power loads having shank and head portions are inserted through the openings up to the head portion in which position the power loads are gripped by the rubber to hold the power loads until forceably removed. The strip with power loads is contained in a box with one end of the strip protruding through an opening in the top of the box. An operator of a powder actuated tool grabs the protruded end of the strip and pulls a section of the strip from the box. He inserts the first power load into the cartridge receiving chamber of the powder actuated tool and by peeling the strip over the head portion of the power load separates the power load from the strip. The box containing the strip can be clipped to the operator's belt or contained in the pocket of an apron.

2 Claims, 9 Drawing Figures

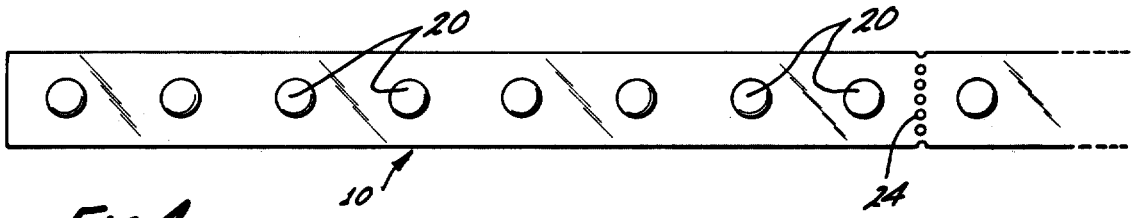
FIG. 4
FIG. 5
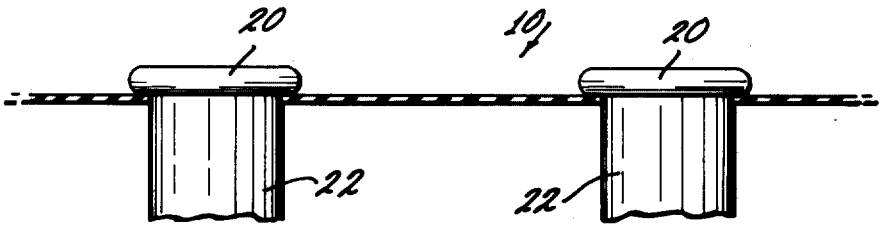
FIG. 6
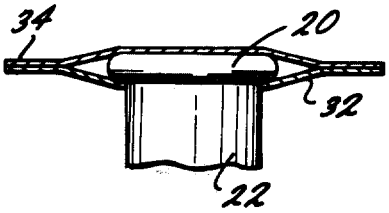
FIG. 7
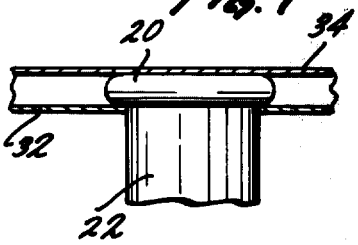
FIG. 8
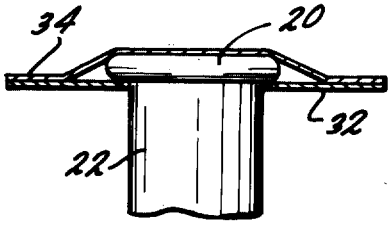
FIG. 9
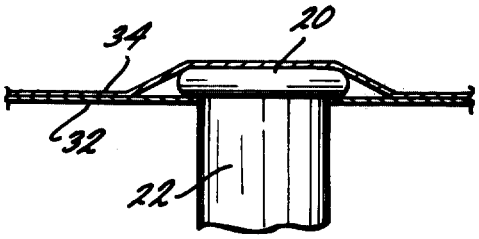

PACKAGING FOR POWER LOADS

HISTORY

This invention relates to packaging for power loads to enable operators of powder actuated tools to easily and conveniently load the tool with the individual power loads.

Powder actuated tools are used in the construction industry to drive pins or nails, e.g. for fastening various items to concrete substrates. Typically, power loads are packaged in boxes and either individually taken from the box and loaded into the tool or as more common where used in large quantities, first dumped into an apron pocket and then individually taken from the pocket and loaded into the tool. As the tool is used and each power load is spent, the operator must reach into the apron, pick out one of the power loads, orient it properly, and insert it into the cartridge receiving chamber of the tool. A number of disadvantages result from this manner of loading. The loose power loads are cumbersome to handle. This is particularly true during the winter season when operators wear gloves. Also, there are power loads having different strengths for different fastening requirements and it is not unusual for loads to become intermixed in an apron pocket. It is then necessary that the operator carefully examine each power load as the use of a wrong power load can cause a serious accident.

It will be understood that the speed of the operator is very important to achieving the benefits of a powder actuated tool and the cumbersome manner in which the operator has to load the tool becomes very critical to the tool's utility. The present invention obviates the disadvantages of the prior loading method by providing the power loads in a strip. The operator merely grabs the end of the strip, pulls it through the opening in the box and slips the first power load into the cartridge receiving chamber and peels the strip back from the head. The end of the strip merely hangs from the box, ready for the next loading. Rapid reloading is accomplished very easily and without requiring the operator to remove his gloves. In that a single strip of power loads contains but one size power load, there is less chance for the operator to load the wrong power load. Other advantages and benefits will be realized by reference to the following detailed description and drawings wherein:

FIG. 4 is a top view of the strip of power loads shown in FIG. 3;

FIG. 5 is an enlarged side view of a small section of the strip of power loads illustrating in greater detail the manner in which the power loads are held in the strip; and FIGS. 6, 7, 8, and 9 are views similar to FIG. 5 illustrating alternate forms of the strip.

Figure 1:
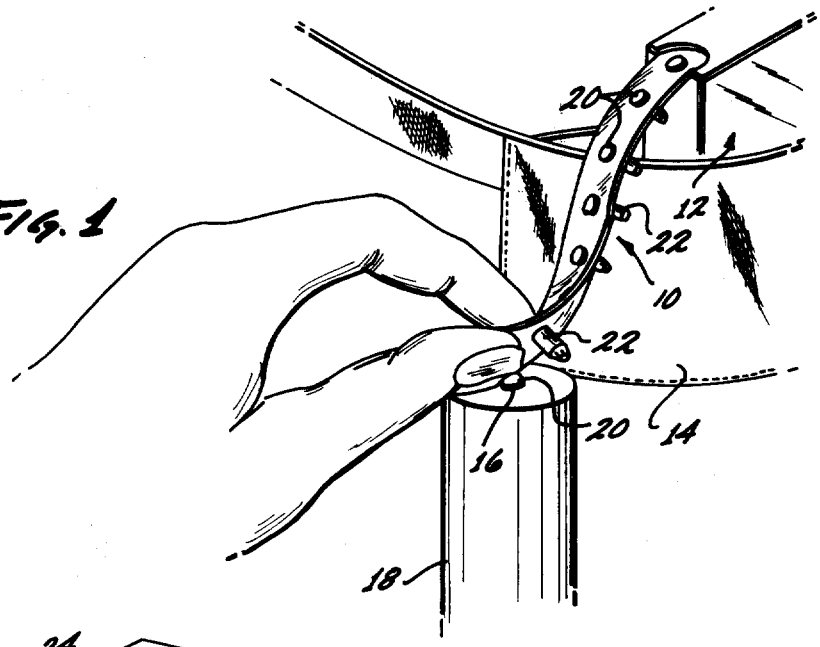
FIG. 1 is a perspective view illustrating a powder actuated tool being loaded with a power load from a strip of power loads packaged in accordance with the present invention.
Figure 2:
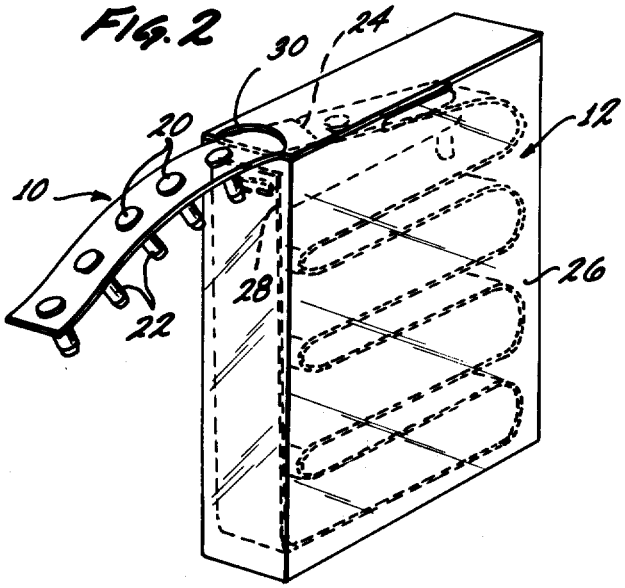
FIG. 2 is a perspective view of the packaging in which the strip of power loads shown in FIG. 1 is contained.

Referring to FIGS. 1 and 2 of the drawings, a strip of fasteners 10 contained within a box 12 is carried in a pocket of an apron 14 worn by an operator. As illustrated in FIG. 1 the operator pulls out a portion of the strip of fasteners to enable the first one of the fasteners to be inserted into the cartridge receiving chamber 16 of a powder actuated tool 18. Whereas the power loads are merely inserted through an opening in the rubberized strip material, the strip is easily stretched over the head 20 of the cartridge 22 to be peeled off the cartridge. The strip of fasteners is more clearly shown in FIGS. 3 and 4 of the drawings and as will be noted, the openings for the power loads are spaced along the length of the strip with perforations 24 provided at spaced intervals which enables the operator from time to time to tear off a portion of the strip. As particularly shown in FIG. 2 of the drawings, the strip is packaged in a box 26 with the trailing end 28 of the strip being fastened to the box near the opening 30. This prevents the last of the strip, with perhaps two or three power loads left, from pulling completely out of the box. The strip as shown is folded or wound in the box in a serpentine manner whereby the strip can be fed continuously through the opening. It will be noted that the opening which is provided in the top of the box is just slightly larger than the head of the cartridges. The opening does not permit the power loads to pass through in a cross wire position, but because the strip is flexible and permits distortion, the strip and fastener are easily oriented lengthwise to the opening and pulled through the opening. Because some distortion is necessary and because of the strip's elasticity, there is resistance and the power loads are prevented from falling out of the box, e.g. when tipped upside down.

It will be understood that the strip material can be made from various forms and from different flexible materials. For example, the strip can be made of a non-elastic laminate as shown in FIG. 6 through 9. The power loads are inserted through a hole in the first layer 32 and the second layer 34 is adhered to the first layer. The two layers adhered together effectively hold the power loads while permitting the load to be peeled out of the strip. The strip materials can be of various types as for example polyethylene and/or paper.

Figure 3:
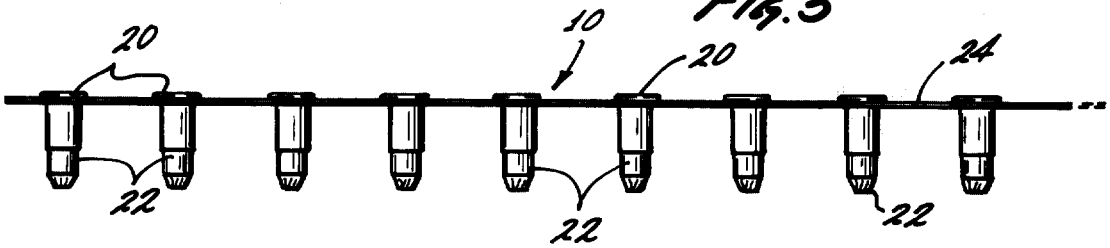
FIG. 3 is a side view of a portion of the strip of power loads in accordance with the present invention.

The preferred single layer strip is illustrated in FIGS. 3, 4, and 5. It is an elastomer as for example neoprene or EPDM having a durometer of 65. It has a thickness of 0.026 to 0.036 inch and a width of 0.500 to 0.520 inch. The holes are 0.125 to 0.135 inch in diameter and spaced apart about 0.625 inch. (The power loads have a diameter of about 0.225 inch.) The first hole is about 2 inches back from the leading end of the strip and the last hole is about 7 inches from the trailing end. A typical strip will have 100 holes (for 100 power loads) and have a length of about 6 feet. Perforations or notches are provided between every ten power loads to permit used portions of the strip to be torn off and discarded.

The box containing the strip is about 6½inches high, with a side width of 4 inches and an end width of 1 inch. The top of the box near one end has a half circle opening with a radius of 0.400 inch. The trailing end of the strip is stapled to the end wall near the opening and runs down the wall to the bottom. The strip is then wound back and forth in the box in a serpentine manner with the leading end protruding through the opening and taped or otherwise lightly tacked to the outside of the box. The power loads are contained in the strip so that with a portion of the strip hanging loosely along the side of the box the heads of the power loads face outwardly from the box (as shown).

Other modifications and improvements will be obvious to those skilled in the art. Thus the invention is not limited to the embodiments as described but encompass the scope of the claims appended hereto.

What I claim is:

1. Packaging for power load cartridges for powder actuated tools comprising; a flat elongate strip, power load cartridges having a head and a shank, attaching means attaching the heads of the cartridges to the strip with the shanks extending from one side of the strip, said attaching means permitting the shanks to be inserted into the cartridge receiving chamber of a powder actuated tool and in the inserted position permitting the strip to be peeled away from the head of the cartridge, a container for said cartridge bearing strip having an opening through which the strip and cartridges can be incrementally removed by the tool operator, and holding means on said container continuously resisting removal of the cartridge bearing strip to prevent inadvertent spillage.

2. Packaging for power loads for powder actuated tools comprising a rectangular box having a top, bottom, two side walls, two end walls, an opening adjacent the juncture of the top and one end wall, a flat elongate elastomeric strip having a width substantially the width of the end wall and one end attached to said one end wall adjacent the opening, said strip extending downwardly from said attached one end along said end wall and across the bottom and being wound in a serpentine manner back and forth across the inside of the box with the other end of the strip protruded out through the opening of the box, and power loads for a powder actuated tool attached to the strip at increments therealong, the shanks of the power loads opposite the power load heads protruded from one side of the strip for insertion while attached to the strip into the cartridge chamber of a powder actuated tool, said one side of the strip facing downwardly toward the bottom of the box as the strip protrudes through the opening, and said opening being of a dimension to resist passage of the strip and power load combination.

* * * * *